US006079346A

United States Patent [19]

Kooren

[11] Patent Number: 6,079,346

[45] Date of Patent: Jun. 27, 2000

[54] TUGBOAT HAVING AZIMUTHAL PROPELLING UNITS

[75] Inventor: Antonie Marius Kooren, Meer, Belgium

[73] Assignee: Sar Holding N.V., Antilles, Netherlands

[21] Appl. No.: 09/077,855

[22] PCT Filed: Dec. 2, 1996

[86] PCT No.: PCT/NL96/00473

§ 371 Date: Sep. 8, 1998

§ 102(e) Date: Sep. 8, 1998

[87] PCT Pub. No.: WO97/20730

PCT Pub. Date: Jun. 12, 1997

[30] Foreign Application Priority Data

Dec. 1, 1995 [NL] Netherlands ..... 1001805

[51] Int. Cl.[7] ..... B63H 25/46

[52] U.S. Cl. ..... 114/151; 114/246; 440/67

[58] Field of Search ..... 440/49, 51, 53, 440/54, 67, 79; 114/242, 246, 248, 144 B

[56] References Cited

U.S. PATENT DOCUMENTS

| | | | |
|---|---|---|---|
| 3,176,645 | 4/1965 | Shatto, Jr. | 440/53 |
| 3,548,775 | 12/1970 | Hammond | 114/144 B |
| 4,175,511 | 11/1979 | Krautkremer | 440/54 |

*Primary Examiner*—Ed Swinehart

*Attorney, Agent, or Firm*—Varnum, Riddering, Schmidt & Howlett LLP

[57] ABSTRACT

There is described a tugboat (1) having three azimuthal propelling units (10, 20, 30), two (10, 20) of which are juxtaposed below the stern (7), symmetrically relative to the main plane of symmetry (2), while the third azimuthal propelling unit (30) is disposed in the main plane of symmetry (2) the stern (6), preferably before the rearmost towing point (8).

6 Claims, 2 Drawing Sheets

TUGBOAT HAVING AZIMUTHAL PROPELLING UNITS

The invention relates to a tugboat having azimuthal propelling units.

Within the framework of the present invention, by the expression "azimuthal propelling unit" is meant a propelling unit whose propelling direction in horizontal direction can be varied through 360°. Such azimuthal propelling units are already known per se, for instance in the form of a nozzle having a screw arranged therein.

Specific requirements are imposed on a tugboat with regard to thrust and maneuverability. For instance, it is desired that a tugboat cannot only produce hauling power in forward direction, but also in rearward direction, and even in lateral direction, although the hauling power producible in lateral direction will be less than the hauling power producible in longitudinal direction.

For instance from the article "Schottel tugs" in Small Ships, Vol.99, No.1204, December 1976, page 95, it is already known to fit a tugboat with azimuthal propelling units because of the maneuverability provided thereby. Such tugboats, also known by the name of "tractor tug", have two azimuthal propelling units which are juxtaposed in transverse direction and, viewed in the longitudinal direction of the tugboat, in a central position. However, some drawbacks are attached to this. For instance, it is not properly possible to continue using the tugboat if one of the propelling units has been damaged.

Generally, the object of the invention is to provide a tugboat which, in respect of the above-mentioned aspects, performs better than the tugs known thus far.

In particular, the object of the invention is to provide a tugboat which is less susceptible to damage, or at least has still good utility in the event of failure of one of the propelling units. A further object of the invention is to provide a tugboat which can travel economically, in particular by utilizing not all propelling units present.

A further object of the invention is to provide a tugboat which can produce more power than the "tractor" tugs known thus far, without the draft being increased. In known "tractor" tugs, an increase of the power producible can be realized by using two stronger propelling units, but a consequence thereof is that the dimensions of the propelling units are increased as well, which has an adverse effect on the draft of the ship.

Another problem concerns the fire extinguishing installations on board a tugboat, intended for extinguishing a fire on shore or on board other ships. In order to meet specific requirements (Fifi 1), a tugboat has two fire extinguishing pumps, driven by the propelling engines. During the use of the fire extinguishing pumps, those engines run at full power. Consequently, without countermeasures, the propelling units would produce thrust at full power, which is of course undesired. On the other hand, in conventional tugs, it is not possible to switch off the propelling units completely by uncoupling them from the associated engines, because the propelling units have to produce a counterforce to the force exterted on the boat by the fire extinguishing water, to enable the boat to be kept in position and/or displaced in a desired direction. The desired power of each propelling unit should be steplessly settable over a wide range, with the associated engine in each case running at full power, for which purpose a slip coupling should be included between each propelling unit and the associated engine. On account of the above-mentioned power requirements, such couplings are fairly expensive.

A further object of the present invention is to alleviate this problem as well.

In order to realize the above objectives, a tugboat according to the present invention has three azimuthal propelling units whose centers, viewed from the top, lie on the angular points of an isosceles triangle.

Thus, it is possible to produce a greater thrust which is distributed over the tugboat in a better manner. In comparison with known "tractor" tugs, that greater thrust can be realized through the use of smaller propelling units, as a result of which the tugboat according to the present invention can have a reduced draft. In practice, the purchase costs of three azimuthal propelling units according to the present invention are about as high as those of two azimuthal propelling units having the same total power.

If it is desired that the boat be provided with a fire extinguishing installation having two fire extinguishing pumps, driven by two of the three driving engines, according to the present invention it is sufficient to include one slip coupling between one of those fire extinguishing pumps and the associated engine. During use of the fire extinguishing installation, the propelling unit of the second engine can be switched off completely, and the ship is entirely controllable by using the propelling unit of the first engine (with slip coupling) and the propelling unit of the third engine, which third engine is not connected to a fire extinguishing pump and can hence be used freely (without slip coupling).

In a simpler variant, wherein the boat comprises a fire extinguishing installation having one fire extinguishing pump, driven by one of the three driving engines, preferably the third, a slip coupling is not even necessary at all: during use of the fire extinguishing installation, the propelling unit of that one engine can be swithed off completely, and the ship is entirely controllable by utilizing the two other propelling units.

These and other aspects, characteristics and advantages of the present invention will be specified by the following description of a preferred embodiment of a tugboat according to the invention, with reference to the accompanying drawings, wherein:

DETAILED DESCRIPTION

Figure 1:
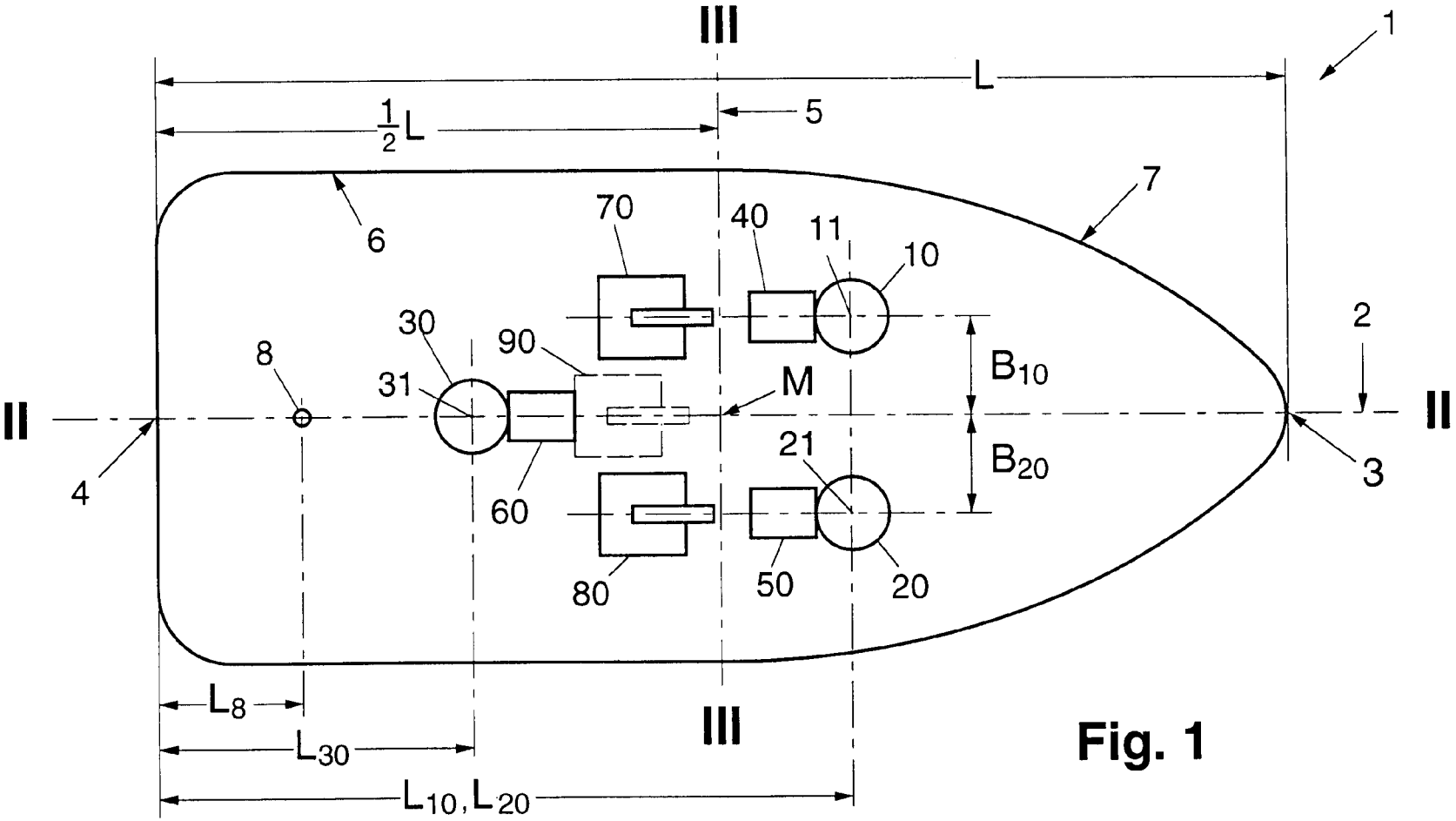
FIG. 1 is a schematic top plan view of a tugboat according to the present invention, to illustrate the positions of the three propelling units.

FIG. 1 schematically shows the contour of a tugboat 1, viewed from the top. Hereinafter, it is assumed that the tugboat 1 is afloat in unloaded condition, and the expression 'horizontal' and 'vertical' are meant relative to the water surface.

Viewed in the transverse direction, the tugboat 1 is substantially symmetric relative to a vertical main plane of symmetry 2, extending in the longitudinal direction of the tugboat 1. The tugboat 1 has a front extreme point 3 located in the main plane of symmetry 2, and a rear extreme point 4 also located in the main plane of symmetry 2. The horizontal distance between the front and rear extreme points 3 and 4 is indicated as the length L of the tugboat 1. Hereinbelow, horizontal length positions will be indicated as measured relative to the rear extreme point 4.

By reference numeral 5, a vertical plane is indicated in the Figures which is perpendicular to the main plane of symmetry 2, and which intersects that main plane of symmetry 2 according to a vertical line M precisely halfway the front and rear extreme points 3 and 4. That vertical line M will be referred to as the center M of the tugboat 1, and the vertical plane 5 will be referred to as the transverse center plane of the tugboat 1. Hereinbelow, horizontal width positions will be indicated as measured relative to the main plane of symmetry 2.

The body portion of the tugboat 1 located behind the transverse center plane 5 will be referred to as the stern 6, and the body portion of the tugboat 1 located before the transverse center plane 5 will be referred to as the stem 7. By a circle 8, the horizontal position is indicated of a towing point provided on the stern 6, i.e. a point intended for securing a towing cable or the like thereto, or for guiding, via that point, a towing cable or the like to a towing which. The tugboat 1 can have several towing points; for instance, a towing point can be provided on the stem 7. If the tugboat 1 has several towing points on the stern 6, the towing point 8 is meant to be the rear towing point, i.e. the towing point whose length position $L_8$ is minimal.

The tugboat 1 comprises three azimuthal propelling units 10, 20 and 30, whose propelling direction in horizontal direction can be varied through 360° relative to the respective vertical axes 11, 21 and 31 associated with the propelling units 10, 20 and 30. Each propelling unit is driven by a separate driving engine, 40, 50, and 60. Such azimuthal propelling units are known per se, for instance in the form of a screw, a nozzle having a screw arranged therein, or a so-called Voith Schneider unit. As the nature and construction of such azimuthal propelling units do not constitute a subject of the present invention, and a skilled person need not have knowledge thereof for a proper understanding of the present invention, they will not be further described.

Viewed in horizontal direction, the three azimuthal propelling units 10, 20 and 30 are arranged according to an isosceles triangle, symmetrically relative to the main plane of symmetry 2. It is preferred that two azimuthal propelling units 10 and 20 be located on one side of the transverse center plane 5, and that the third azimuthal propelling unit 30 be located on the other side of the transverse center plane 5.

In the preferred embodiment illustrated, a first azimuthal propelling unit 10 and a second azimuthal propelling unit 20 are located below the stem 7, symmetrically on both sides of the transverse center plane 5. By this it is meant that the length position $L_{10}$ of the vertical axis of rotational symmetry 11 of the first azimuthal propelling unit 10 is equal to the length position $L_{20}$ of the vertical axis of rotational symmetry 21 of the second azimuthal propelling unit 20, and that these positions are greater than 0.5 L, while the width position $B_{10}$ of the vertical axis of rotational symmetry 11 of the first azimuthal propelling unit 10 is equal (but opposite) to the width position $B_{20}$ of the vertical axis of rotational symmetry 21 of the second azimuthal propelling unit 20. As regards the length positions $L_{10}$ and $L_{20}$, they are preferably smaller than 0.8 L, more preferably smaller than 0.65 L. If a towing point is provided on the stem 7, the length position thereof is preferably greater than or equal to $L_{10}$ and $L_{20}$.

The vertical axis of rotational symmetry 31 of the third azimuthal propelling unit 30 lies in the main plane of symmetry 2, and has a length position $L_{30}$ smaller than 0.5 L, and preferably greater than or equal to 0.15 L. Preferably, $L_{30}$ is smaller than or equal to 0.4 L, more preferably smaller than or equal to 0.25 L. It is preferred that $L_{30}$ be greater than or equal to $L_8$.

Figure 2:
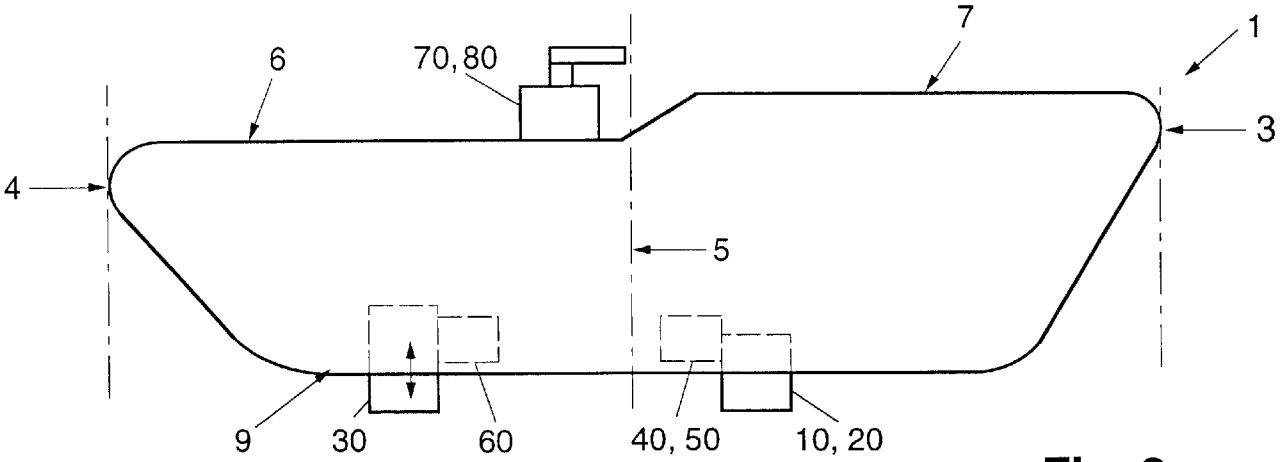
FIG. 2 is a schematic longitudinal section taken on the line II—II in FIG. 1.
Figure 3:
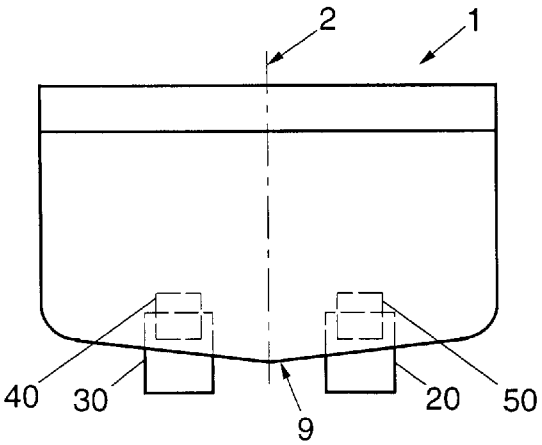
FIG. 3 is a schematic cross section taken on the line III—III in FIG. 1.

The three azimuthal propelling units 10, 20 and 30 can be mounted entirely below the bottom 9 of the tugboat 1. However, as is indicated in dotted lines in FIGS. 2 and 3, it is also possible that the azimuthal propelling units 10, 20 and 30 are partly recessed in the bottom 9 of the tugboat 1, so that the tugboat 1 will have a less great draft. This applies in particular to the third azimuthal propelling unit 30, located at the center of the tugboat 1, because, viewed in cross section, the bottom 9 of the tugboat 1 is generally more or less V-shaped, so that in fact, the lowermost point of the third azimuthal propelling unit 30 determines the draft of the tugboat 1. Conventional tugboats having azimuthal propelling units have only two of such azimuthal propelling units, which are comparable with the first and second azimuthal propelling units 10 and 20 according to the present invention. Through the addition of a third azimuthal propelling unit 30 in the main plane of symmetry 2, but at a different length position, the following advantages are realized.

If one of the propelling units is damaged, this means, in conventional tugboats, a loss of 50% of the thrust, while in the tugboat according to the present invention, only about 33% of the thrust will in that case be lost.

In conventional "tractor" tugboats, the propelling units are disposed at equal length positions. A consequence thereof is that when the boat is moved truly transversely to the longitudinal direction, and, moreover, a pulling or pushing force is to be exerted in that direction, a fairly large part of the installed power is lost: this loss can be about 25%, depending on the type of the propelling units installed. In conventional tugboats with the screws mounted at the rear of the boat, that loss may even be 70%. Owing to the presence of a third propelling unit 30 at a length position different from that of the other two propelling units, the maneuverability in lateral direction is improved, and the maximally producible pulling or pushing force transverse to the longitudinal direction is increased considerably.

Since the third azimuthal propelling unit 30 is located in the main plane of symmetry 2, it is possible in an easy manner to travel straight on utilizing only one propelling unit, viz. the third propelling unit 30. This possibility, which can for instance be used when the tugboat 1 travels in unloaded condition, provides a saving of fuel and a reduced wear.

The three propelling units according to the present invention can jointly develop a thrust greater than the thrust that can be produced by two propelling units at an equal draft. In accordance with the present invention, it is even possible to realize a greater total thrust while the three propelling units are individually chosen to be smaller than the individual propelling units of the conventional "tractor" tugboats, whereby the draft of the tugboat is reduced as well.

It will be understood by anyone skilled in the art that changes and modifications of the embodiment described are possible, which fall within the framework of the present invention and within the protective scope of the claims. For instance, during the building of a conventional "tractor tug", it is possible to reserve space for later incorporation of a third propelling unit, with the construction of the boat being designed for such incorporation.

It is also possible that one or several, for instance the third one, of the propelling units are retractably mounted, enabling a propelling unit that is not being used to be retracted to a position within the profile of the bottom of the boat. As a result, the resistance during travelling will be reduced, which means a saving of fuel.

In tugboats that mainly operate according to the so-called "push/pull" system, the position of the propelling units can be reversed, i.e. one unit at the front and two units at the rear.

What is claimed is:

1. A tugboat having opposite sides, a front extreme point, a rear extreme point and a longitudinally extending main plane of symmetry extending between said front extreme point and said rear extreme point, said tugboat comprising first, second and third azimuthal propelling units, said first and second azimuthal propelling units being juxtaposed about said longitudinal main plane of symmetry and at a first distance from said rear extreme point, said third azimuthal propelling unit being positioned substantially in said longitudinally extending main plane of symmetry at a second distance, different from said first distance, from said rear extreme point.

2. A tugboat according to claim 1, wherein said tugboat further comprises a transverse center plane extending between said opposite sides and disposed substantially equidistant from said front extreme point and said rear extreme point and wherein said third azimuthal propelling unit is disposed on one side of said transverse center plane and said first and second azimuthal propelling units are positioned on another side of said transverse plane, opposite said one side of said transverse center plane.

3. A tugboat according to claim 2, wherein said first and second propelling units are positioned between said transverse center plane and said front extreme point and said third propelling unit is located between said transverse center plane and said rear extreme point.

4. A tugboat according to claim 3 wherein said tugboat further comprises a towing point positioned a predefined distance from said rear extreme point and wherein said propelling unit is positioned a distance which is at least equal to said predefined distance from said rear extreme point.

5. A tugboat in accordance with claim 3 wherein said tugboat further comprises a plurality of towing points and at least one of said towing points is positioned a predefined distance from said rear extreme point and said third propelling unit is positioned a distance from said rear extreme point which is at least equal to said predefined distance.

6. A tugboat according to claim 1 and having a length L extending between said front extreme point and said rear extreme point and wherein said first distance has a length between 0.5 times L and 0.65 times L and wherein said second distance has a length between 0.15 times L and 0.25 times L.

* * * * *